US007770587B2

(12) United States Patent
Bennett

(10) Patent No.: US 7,770,587 B2
(45) Date of Patent: Aug. 10, 2010

(54) INTERLOCKING CONTAINER

(75) Inventor: Kyle M. Bennett, Brown Deer, WI (US)

(73) Assignee: Rexam Beauty and Closures, Inc., Sussex, WI (US)

( * ) Notice: Subject to any disclaimer, the term of this patent is extended or adjusted under 35 U.S.C. 154(b) by 365 days.

(21) Appl. No.: 11/452,080

(22) Filed: Jun. 13, 2006

(65) Prior Publication Data

US 2006/0283476 A1 Dec. 21, 2006

Related U.S. Application Data

(60) Provisional application No. 60/690,361, filed on Jun. 14, 2005.

(51) Int. Cl.
*A45D 33/24* (2006.01)

(52) U.S. Cl. ..... 132/294

(58) Field of Classification Search ..... 132/286, 132/293–295, 297, 301, 313–317; 206/581, 206/823; 220/324, 4.21, 4.22, 4.23, 23.83, 220/23.86, 507, 528
See application file for complete search history.

(56) References Cited

U.S. PATENT DOCUMENTS

| | | | | |
|---|---|---|---|---|
| 1,538,473 | A | 5/1925 | Cross | |
| 1,632,864 | A | 6/1927 | Weber | |
| 1,818,793 | A * | 8/1931 | Coryell | 132/297 |
| 2,547,971 | A * | 4/1951 | Polin et al. | 132/297 |
| 4,452,371 | A | 6/1984 | Jurek | |
| 4,726,387 | A * | 2/1988 | Sarica | 132/313 |
| 4,736,538 | A | 4/1988 | Pierce et al. | |
| 4,793,633 | A | 12/1988 | Rose, Jr. | |
| 5,222,619 | A | 6/1993 | Gregory | |
| 5,248,030 | A | 9/1993 | Tarozzi | |
| 6,145,515 | A | 11/2000 | Wu | |
| 6,237,612 | B1 | 5/2001 | Heyer | |
| 2003/0154996 | A1 * | 8/2003 | Bourjal | 132/293 |

OTHER PUBLICATIONS

Promotional materials for a cosmetic compact of a type understood to be commercially available from Smashbox Cosmetics; printed from website http://sephora.com; Jun. 8, 2006; one sheet.
Cosmetic compact of a type understood to be commercially available from Smashbox Cosmetics (five images, one sheet).

* cited by examiner

*Primary Examiner*—Cris L Rodriguez
*Assistant Examiner*—Rachel R Steitz
(74) *Attorney, Agent, or Firm*—Chad D. Bruggeman; John F. Salazar; Middleton Reutlinger

(57) ABSTRACT

A case for storing a cosmetic is provided. The case has a base with a first latch portion and configured to support the cosmetic, a cover securable to the base and having a second latch portion, and an applicator for applying the cosmetic and having a third latch portion. The third latch portion engages the first latch portion and the second latch portion to secure the cover to the base when the case is in a closed position.

13 Claims, 9 Drawing Sheets

INTERLOCKING CONTAINER

CROSS REFERENCE TO RELATED PATENT APPLICATIONS

This application claims the benefit under 35 U.S.C. 119(e) of U.S. Provisional Application No. 60/690,361, having a filing date of Jun. 14, 2005, titled "INTERLOCKING CONTAINER," the disclosure of which is hereby incorporated by reference.

BACKGROUND

The present application relates generally to the field of storage systems or containers for storing one or more articles, such as a cosmetic article. More particularly, the present application relates to the opening or latching systems used to secure such containers in a closed position.

It is generally known to provide a container used for storing one or more cosmetic articles (e.g., cosmetic substances, applicators, accessories, etc.) or other articles such as tissues (e.g., wet, dry, etc.), medication, and the like. Such known containers typically include a base and a cover. The base generally defines a cavity configured to store the one or more articles, while the cover is movably coupled to the base and configured to close and seal this cavity. Such known containers also typically include an opening or latching mechanism to facilitate engaging and disengaging the cover and the base such that the cover will be secured to the base until the opening mechanism is actuated by a user. Known opening or latching mechanisms include latches, levers, switches, and handles. Such known opening or latching mechanisms are often provided on an outer surface of the container and often disrupt the continuity of profile of the container.

Thus there is a need for a container having an opening or latching mechanism that is concealed from the view of a user. There is also a need for a container wherein the outward profile of the container is not disrupted by an opening or latching mechanism. There is further a need for a container configured to support an applicator in a discrete manner. There is further a need to protect an applicator, particularly an operating portion of the applicator, when stowed. There is further a need for a container that combines an applicator with an opening or latching mechanism of the container. There is further a need for a container in the form of a cosmetic compact that incorporates a cosmetic applicator into to an opening or latching mechanism of the cosmetic compact.

Accordingly, it would be desirable to provide a container capable of accomplishing any one or more of these or other needs.

SUMMARY

The present invention relates to a case for storing a cosmetic. The case comprises a base having a first latch portion and configured to support the cosmetic, a cover securable to the base and having a second latch portion, and an applicator for applying the cosmetic and having a third latch portion. The third latch portion engages the first latch portion and the second latch portion to secure the cover to the base when the case is in a closed position.

The present invention also relates to a case for storing a cosmetic. The case comprises a base configured to support the cosmetic, a cover securable to the base, and an applicator having a slot engageable with the cover and the base to secure the case in a closed position.

The present invention further relates to a compact case. The compact case comprises a base, a cover securable to the base, and an applicator engageable with at least one of the base and cover to secure the case in the closed position. The applicator has an operating portion which substantially remains in a use position relative to a body portion when engaging at least one of the base and the cover. The base and the cover cooperate to define an aperture configured to receive the operating portion of the a receptacle for shielding the operating portion.

DETAILED DESCRIPTION

Figure 1:
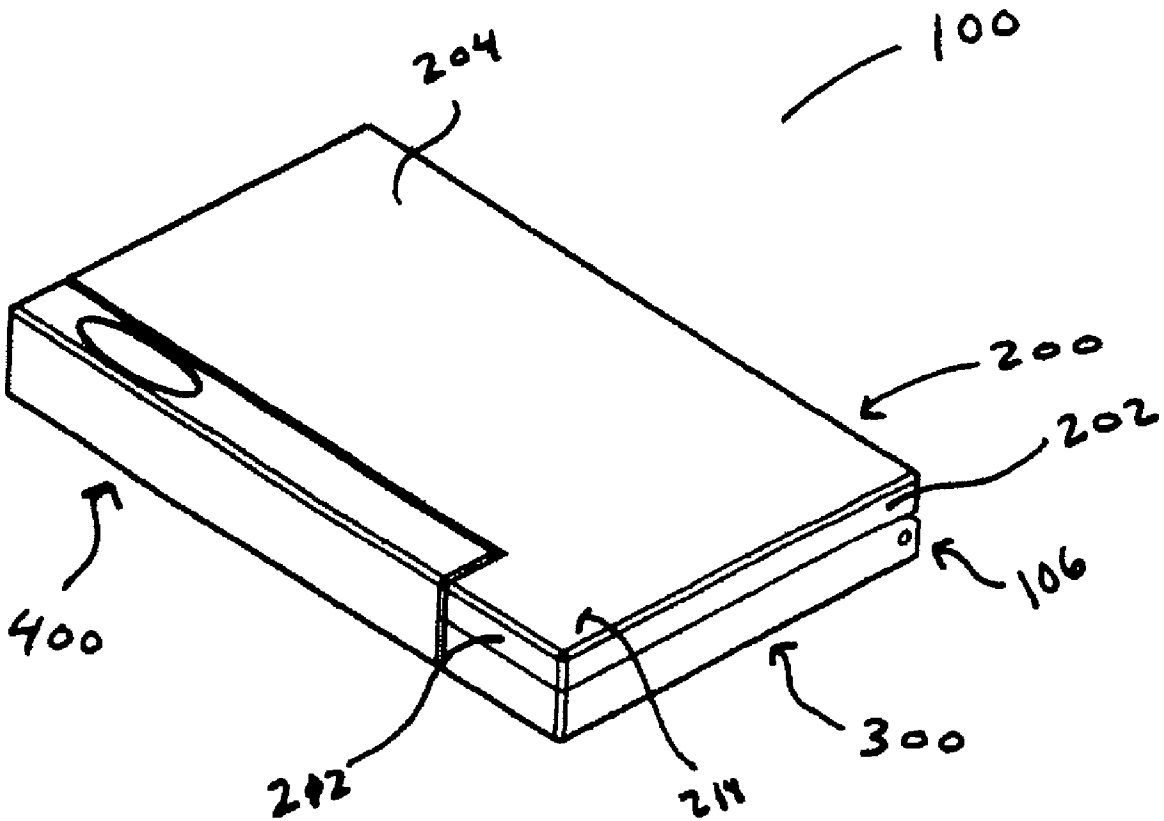
FIG. 1 is a schematic representation of a top perspective view of a front side of a container in a closed and latched position according to one exemplary embodiment.
Figure 2:
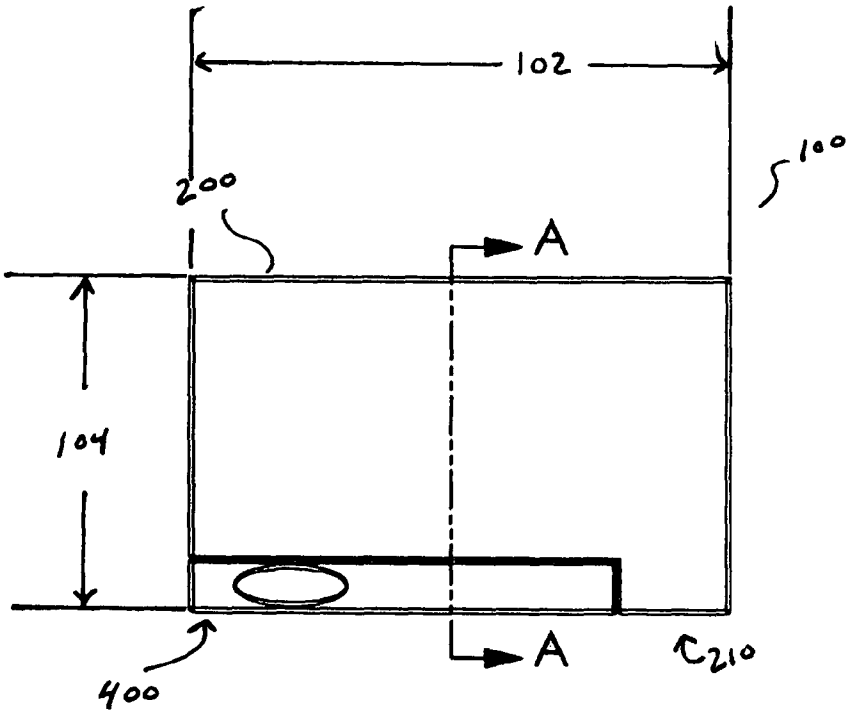
FIG. 2 is a schematic representation of a top plan view of a container according to the embodiment of FIG. 1.
Figure 3:
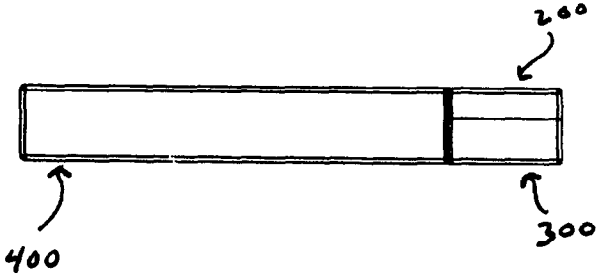
FIG. 3 is a schematic representation of a front plan view of a container according to the embodiment of FIG. 1.
Figure 4:
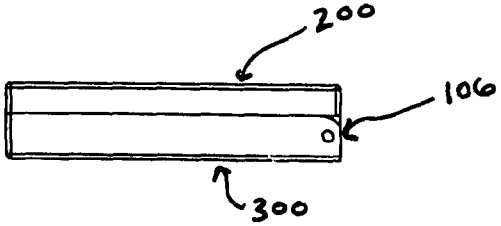
FIG. 4 is a schematic representation of a side plan view of a container according to the embodiment of FIG. 1.

Referring generally to the FIGURES, a case (e.g., cosmetic compact, etc.) is shown according to one nonexclusive exemplary embodiment. The case (shown schematically as a container 100) comprises a first portion (e.g., lid, closure, top, etc.), shown schematically as a cover portion 200, a second portion (e.g., bottom, receptacle, etc.), shown schematically as a base portion 300, and third portion (e.g., latch device, removable member, etc.), shown schematically as a applicator 400. The first portion and second portion cooperate to provide a conveniently sized storage system suitable for holding one or more articles, such as a cosmetic substance (e.g., eye shallow, lip gloss, blush, pressed powder, etc.). The container is preferably sized to conveniently fit into a user's bag, purse, pocket, etc.

The first portion is coupled to the second portion such that a user may selectively move the first portion between a first or closed position (wherein the one or more articles provided therein are concealed) and a second or open position (wherein the one or more articles supported therein are revealed). To secure (e.g., latch, lock, etc.) the first portion to the second portion when in the closed position, or at least to assist in securing the first portion to the second portion, the third portion is provided. The third portion is detachably coupled to the first portion and the second portion and has a structure configured to detachably engage portions (shown schematically as a flange 220 and a flange 330) of both the first portion and the second portion. According to a preferred embodiment, the third portion is configured to slidably engage the first and second portions. The third portion may also function an applicator useful in applying one or more articles provided in the container (e.g., a brush or similar applicator for applying a cosmetic substance to the face of the user, etc.).

One advantageous feature of using the third portion to at least partially assist in securing the first portion to the second portion is that the profile of container 100 can be provided with a "cleaner" visual appearance for a user because the opening or latch mechanism can be hidden from view by the third portion. One advantageous feature of combining an applicator into the third portion is that such an applicator can be kept separate from the articles stored within the container. This may improve the usefulness of the applicator and/or may provide for improved organization within the container.

FIGS. 1 through 4 show a container 100 in a storage position (i.e., a closed and latched position) according to an exemplary embodiment. The container 100 generally includes a cover 200, a base 300, and an applicator 400. It should be noted at the outset that the container may be configured in a wide variety of shapes to accommodate varying design criteria, for example, as a generally rectangular shaped container 100 having a length 102 that is at least slightly greater than a width 104 as illustrated in the FIGURES. According to various alternative embodiments, the container may be configured into other well-known or otherwise suitable shapes having linear surface and/or nonlinear edges and surfaces. For example, the container may be a generally cylindrical or octagonal container. Further, it should be noted that the third portion does not have to be configured as an applicator, and according to various alternative embodiments, may provide no function other than as latching mechanism.

In the storage position, the cover portion 200 is closed relative to the base portion 300 and the applicator 400 is engaged with a portion of both the cover portion 200 and the base portion 300 for securing the cover portion 200 relative to the base portion 300. The applicator 400 is shown as being disposed in a front portion of container 100 and at least partially defining a top surface, a bottom surface, a front edge surface, and a side edge surface of the container 100. According to various alternative embodiments, the applicator 400 may be disposed anywhere about the container 100 depending on certain design criteria and/or may define any number of surfaces (e.g., one, two, five, etc.). To unlatch the container 100, the applicator 400 is configured to slidably disengage from the cover portion 200 and the base portion 300. According to the embodiment illustrated, the applicator 400 is configured for translational movement in a direction (shown as being from right to left) substantially transverse to the direction the cover portion 200 moves relative to the base portion 300.

Figure 5:
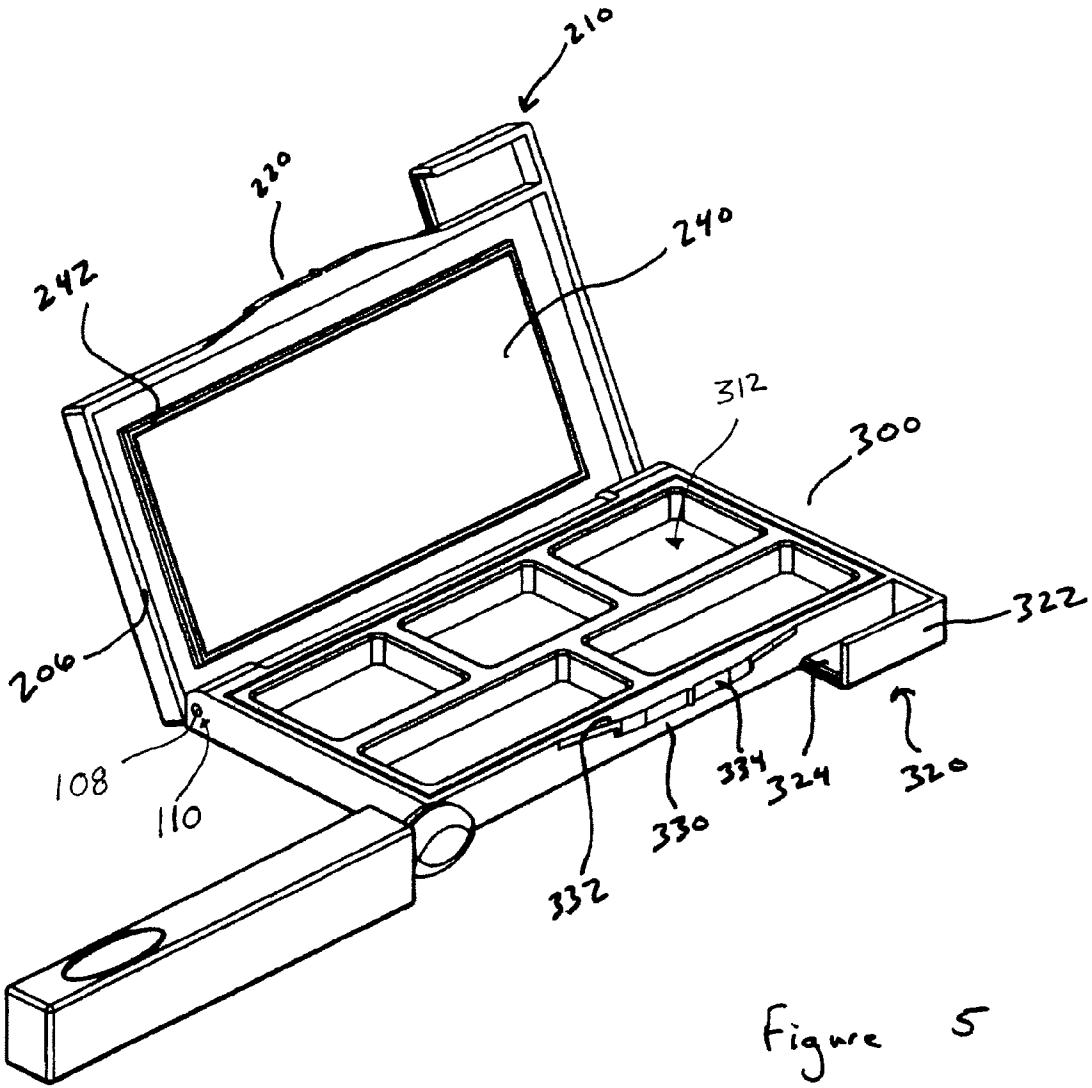
FIG. 5 is a schematic representation of a top perspective view of a front side of a container in an open position according to the embodiment of FIG. 1.

FIG. 5 shows the container 100 in an unlatched and opened position thereby revealing the inner configuration of the container 100 according to an exemplary embodiment. In the opened position, the cover portion 200 may be independent from the base portion 300 or coupled with the base portion 300. The cover portion 200 can be coupled to the base portion 300 by being integral with the base portion 300 (e.g., formed as a one-piece body wherein a living hinge or other equivalent coupling mechanism pivotally couples the cover portion 200 to the base portion 300) or by being attached to the base portion 300. According to the illustrated embodiment, the cover portion 200 is coupled to the base portion 300 by being attached by a hinge mechanism 106. The hinge mechanism 106 generally comprises a pivot shaft or rod 108 inserted into an aperture or the bore 110 provided in at least one of the cover portion 200 and the base portion 300. The pivot rod 108 may be integrally formed with the cover portion 200 or the base portion 300, or alternatively, may be provided as a separated component as illustrated.

Figure 6:
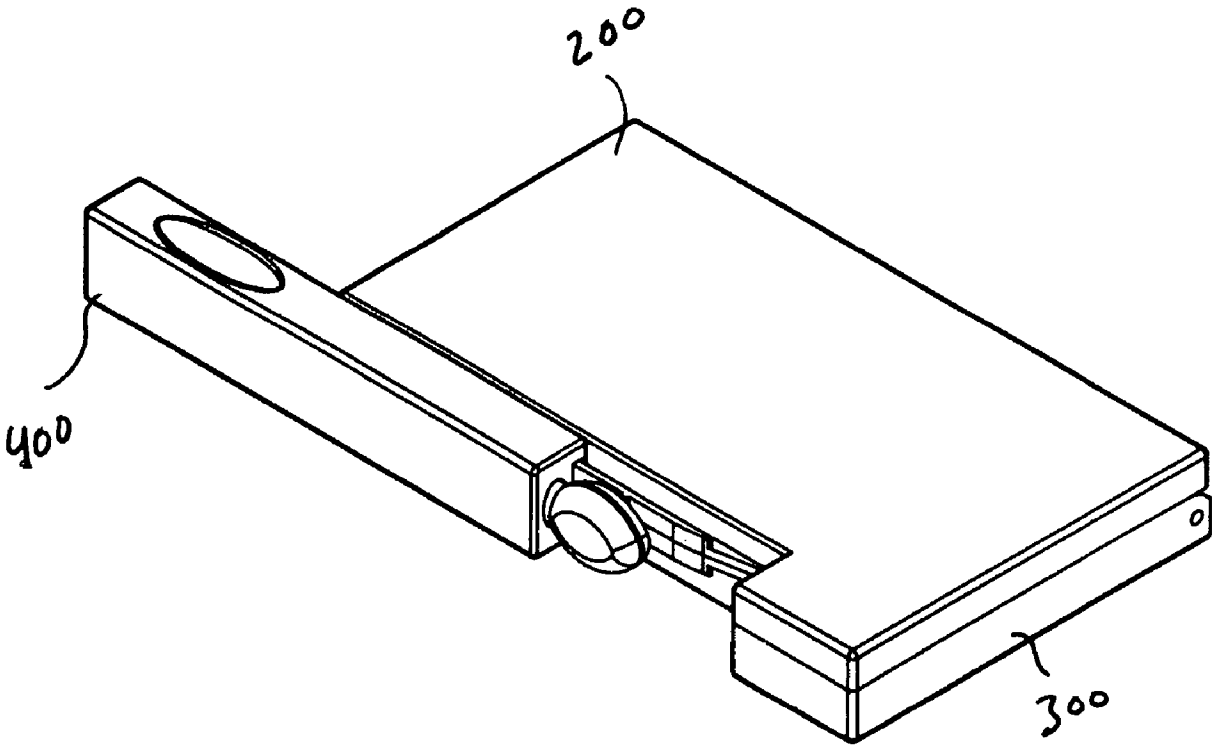
FIG. 6 is a schematic representation of a top perspective view of a front side of a container in a closed position with an applicator in an intermediate position according to the embodiment of FIG. 1.
Figure 7:
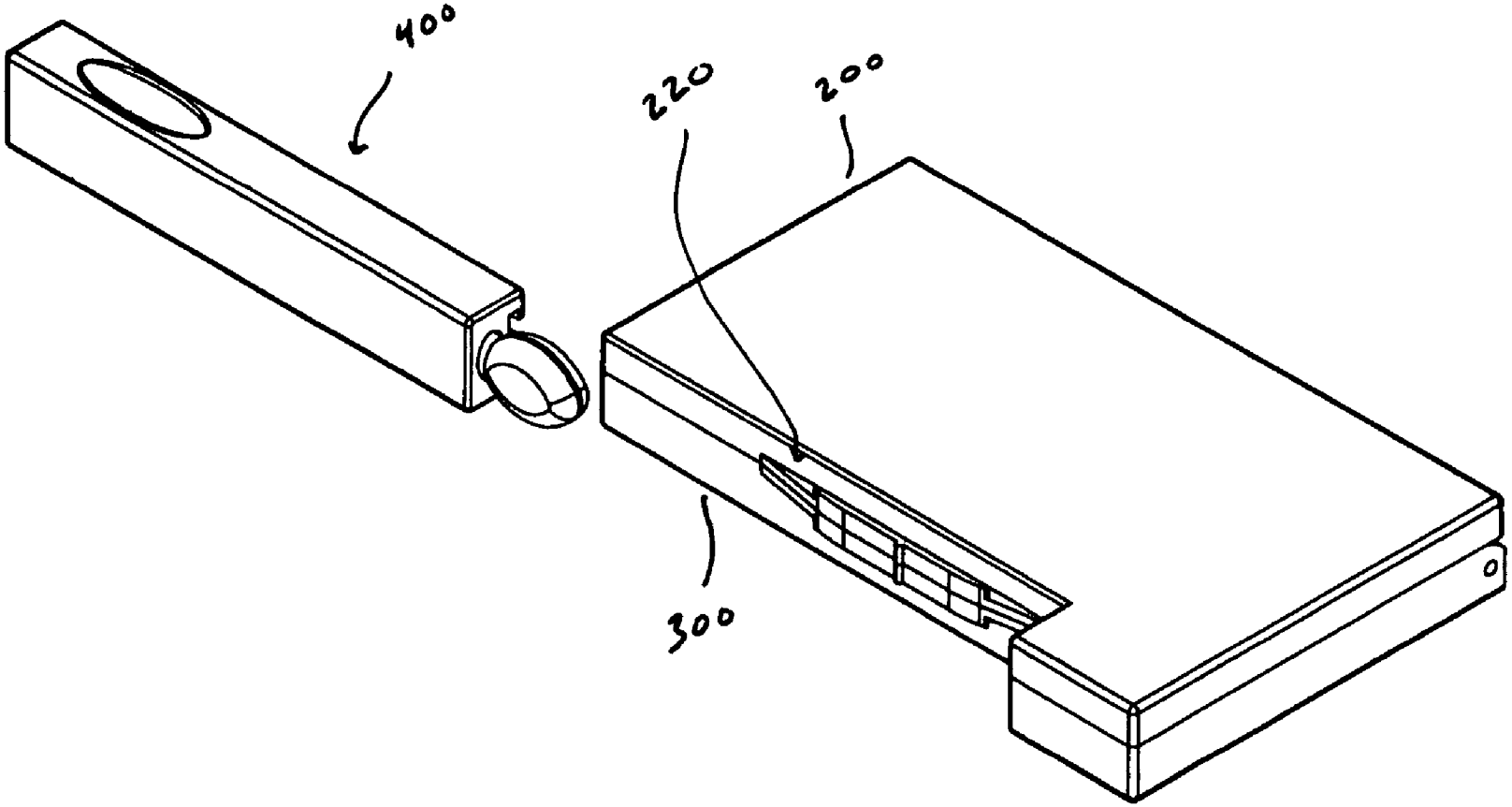
FIG. 7 is a schematic representation of a top perspective view of a front side of a container in a closed and at least partially unlatched position with an applicator detached according to the embodiment of FIG. 1.

FIG. 6 shows the container 100 in the closed position with the applicator 400 in an intermediate position, while FIG. 7 shows the container in the closed position with the applicator 400 entirely disengaged from the cover portion 200 and the base portion 300. In the closed position and with the applicator 400 entirely disengaged from the cover portion 200 and the base portion 300, movement of the container 100 between the closed position and the open position is relatively uninhibited (i.e., the cover portion 200 is not otherwise latched to the base portion 300). This permits a user to freely move the cover portion 200 relative to the base portion 300 to reveal the one or more articles contained within. According to various alternative embodiments, a secondary or supplemental latching system may be provided between the cover portion 200 and the base portion 300 in addition to the latching mechanism provided by the applicator 400. For such a configuration, a user would have to remove the applicator 400 and undue the supplemental latching system before accessing the one or more articles of the container 100.

Referring further to FIG. 1, a cover portion 200 is shown according to an exemplary embodiment. The cover portion 200 has an end wall 204 (e.g., platform, top, top surface, etc.) and a side wall 202 (skirt, peripheral surface, etc.) extending downward therefrom at an orientation that is generally perpendicular to the end wall section 204. The side wall 202 is generally rectangular in shape and has a bottom face or surface 206 (shown in FIG. 2) configured to interface (e.g., mate with, etc.) a corresponding structure on the base portion 300. According to various alternative embodiments, the cover portion 200 may not include a side wall or may included a side wall configured to fit over and/or within a corresponding structure on the base portion 300.

Figures 10, 11:
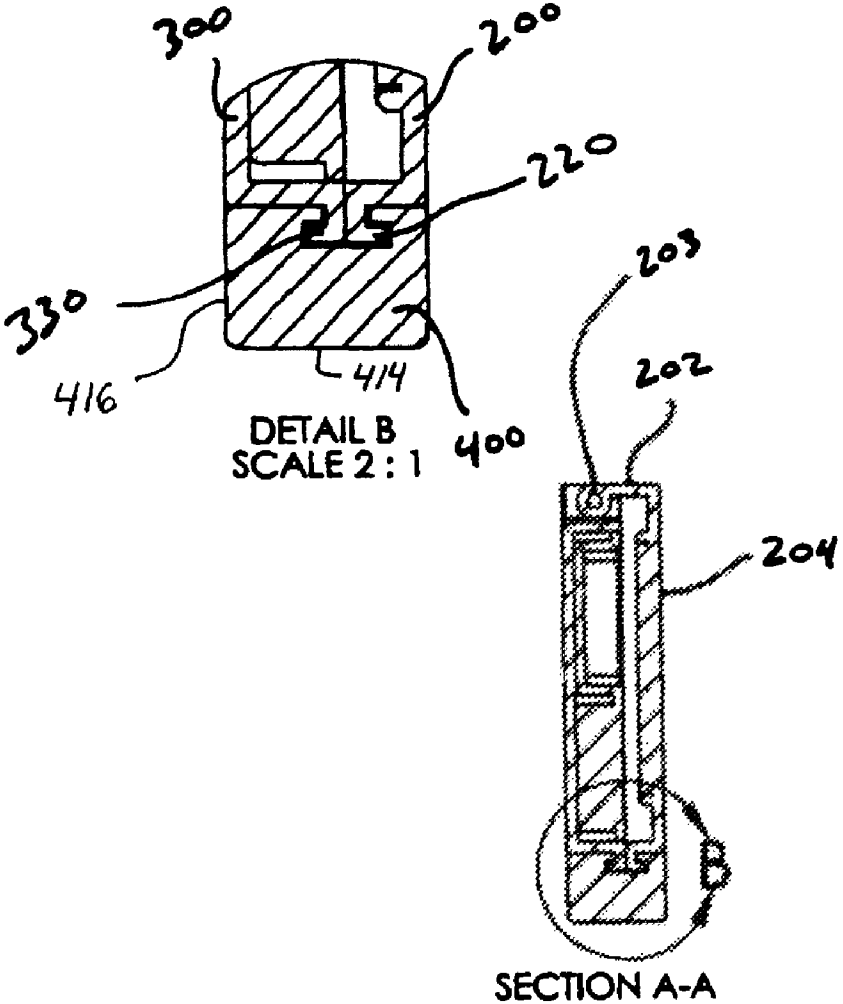
FIG. 10 is a cross-sectional view of a portion of the container shown in FIG. 2 taken across line A-A at the location of an opening mechanism according to an exemplary embodiment.
FIG. 11 is a detailed view of a portion of the container shown in FIG. 10 taken about B-B.

The cover portion 200 also includes a structure to facilitate coupling the cover portion 200 to the base portion 300. Referring to FIG. 10, which is a cross-sectional view of a portion of the container 100 taken across a line A-A in FIG. 2, a rear portion of side wall 202 defines an aperture (shown as a centrally disposed bore 203) configured to receive the pivot rod (not shown). According to various alternative embodiments, the cover portion 200 may have any of a variety of configurations enabling the cover portion 200 to be coupled to the base portion 300 (e.g., living hinge, snap-fit, threaded interface, etc.).

The cover portion 200 further includes a portion or region (schematically shown as an extension 210) at a front portion of the cover portion 200 for at least partially concealing and/or shielding a portion of the applicator 400 (e.g., an operating portion, etc.). As shown, the extension 210 and the remaining portion of the cover portion 200 are integrally formed as a single unitary body. Similar to the remaining portion of the cover portion 200, the extension 210 includes a side wall 212 and an end surface 214. When the container 100 is in the closed position, the extension 210 cooperates with a corresponding structure on the base portion 300 to define a cavity 216 configured to receive a portion of the applicator 400 (e.g., the bristles of a brush, the tip of a cosmetic pencil, etc.). By providing the cavity 216, the operating portion (e.g., the head, the tip, etc.) of the applicator 400 can be protected against contamination (e.g., dust, dirt, etc.) or other potential damage. Further, the operating portion of the applicator 400 is likely to contain remains of the cosmetic substance for which it is used to apply. Placing this portion of the applicator 400 in the cavity 216, will reduce the likelihood that the cosmetic substance will be exposed to an unintended surface (e.g., the inside of a bag or purse, a pocket of the user, etc.). Further still, such a configuration allows the applicator 400 to substantially remain in a use position when being stowed (e.g., the operating portion does not have to be removed from or retracted relative to a body portion of the applicator 400). This limits the number of steps a user must take before applying a cosmetic since the applicator 400 is already in a use position once it is detached from the container 100.

The cover portion 200 further includes a structure for engaging the applicator 400. An exemplary embodiment of such a structure is shown in FIGS. 5 through 7 wherein the applicator 400 is removed (or at least partially removed) from the cover portion 200 and the base portion 300. The cover portion 200 includes a projection (e.g., rib, lip, etc.), shown as a flange 220 integrally formed with a front portion of side wall 204. The flange 220 includes a first portion 222 outwardly extending from the front portion of the side wall 204 and a second portion 224 upwardly extending from the first portion 222. When the container 100 is in the closed position, the flange 220 combines with a corresponding structure on the base portion 300, as is detailed below, to provide a T-shaped flange configured to slidably engage a corresponding slot on applicator 400. According to various alternative embodiments, the flange 220 and the corresponding flange on the base portion 300 may cooperate to form any of a number of suitable cross-sectional shapes (e.g., circular, rectangular, triangular, etc.).

Referring to FIG. 7 in particular, the flange 220 extends continuously across only a portion of the front surface of the side wall 202. According to various alternative embodiments, the flange 220 may be discontinuous and/or may span substantially the entire front surface of the side wall 202. According to the embodiment illustrated, the first portion 222 of the flange 220 is slanted (e.g., tapered, sloped, angled, rounded, etc.) at its ends for facilitating the translational movement of the applicator 400. Further, the second portion 224 is not shown as extending from the slanted ends of the first portion 222. According to various alternative embodiments, one or more of the ends of first portion 222 may be straight as opposed to slanted and/or the second portion 224 may be provided across the entire length of the first portion 222.

Figure 8:
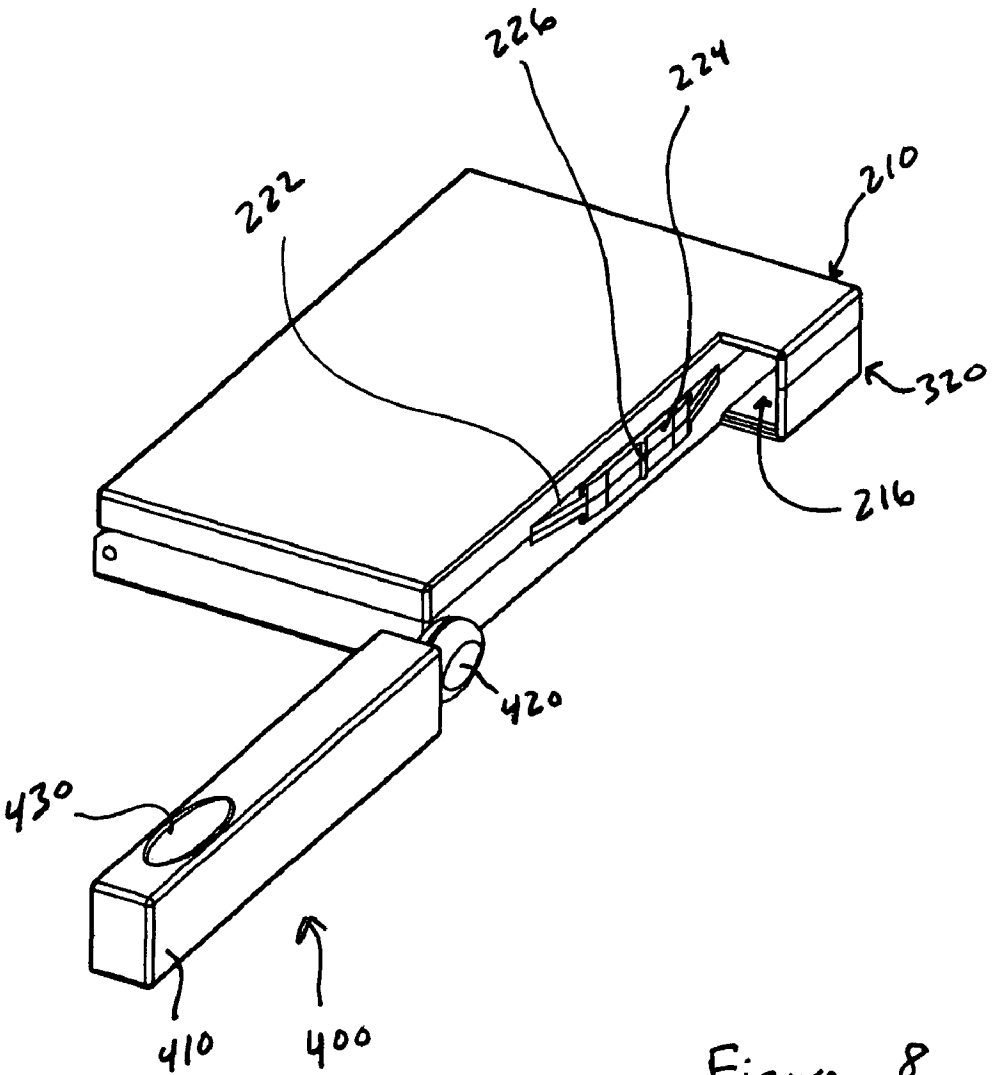
FIG. 8 is a schematic representation of a top perspective view of a front side of a container in a closed position.

Referring to FIG. 8, the flange 220 includes a projection 226 (e.g., tab, rib, lip, etc.) located on the second portion 224 for frictionally engaging a portion of the applicator 400 for securing the applicator 400 in the latched position. According to an exemplary embodiment, the applicator 400 snaps over the projection 226 when sliding from left to right into the latched position. According to various alternative embodiments, any other suitable mechanism may be provided for securing the applicator 400 in the latched position.

Referring to FIG. 5, the underside of the cover portion 200 is shown having an accessory (shown schematically as a mirror 240) coupled thereto. The mirror 240 may be coupled to the underside of the cover portion 200 using any of a variety of suitable techniques (e.g., mechanical fasters, adhesives, etc.). As shown in the FIGURES, the underside of the cover portion 200 includes a projection in the form of a raised rim 242 configured to receive the mirror 240. The raised rim 242 may facilitate in the coupling of the mirror 240 to the underside of the cover portion 200 by providing guidance as to where the mirror 240 should be installed and/or by providing a structure to which the mirror 240 can engage (e.g., press-fit, snap-fit, etc.). According to a preferred embodiment, a combination of an adhesive and the raised rim 242 is used in coupling the mirror 240 to the cover portion 200.

Figure 9:
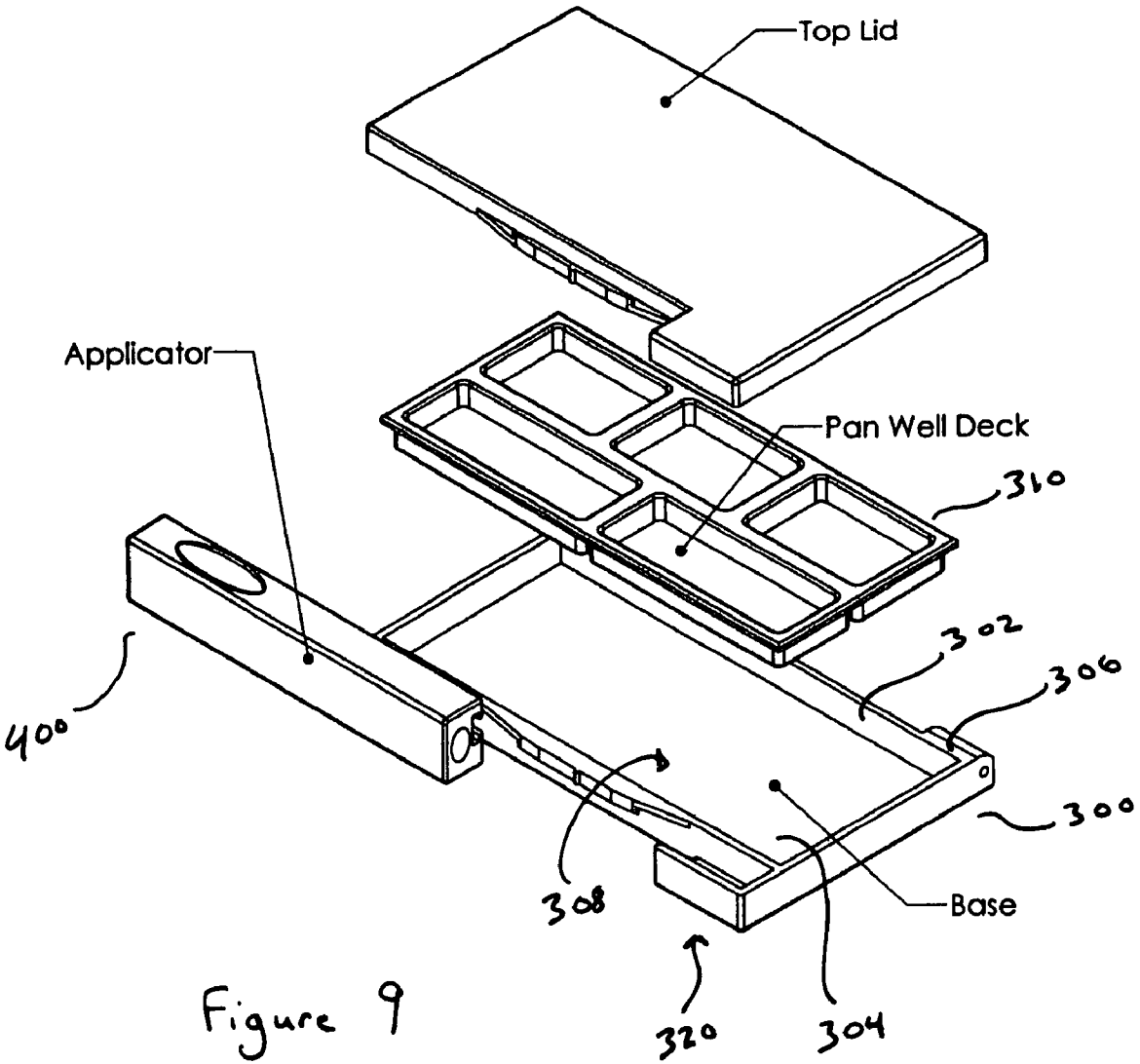
FIG. 9 is a schematic representation of an exploded perspective view of a container according to the embodiment of FIG. 1.

Referring to FIGS. 5 and 9, a base portion 300 is shown according to an exemplary embodiment. The base portion 300 has an end wall 304 (e.g., platform, bottom, bottom surface, etc.) and a side wall 302 extending upward therefrom at an orientation that is generally perpendicular to the end wall section 304. The side wall 302 is generally rectangular and has a top face or surface 306 configured to interface (e.g., mate with, etc.) a corresponding structure (i.e., bottom edge 206) of the base portion 300. Side wall 302 defines an aperture 308 (e.g., cavity, receptacle, etc.) suitable for retaining one or more articles, such as cosmetic articles (e.g., cosmetic substances, accessories, tools, etc.) or any other article (e.g., tissues (wet, dry), etc.). The size and shape of the cavity 308 may vary depending on a number of factors, including the size, shape, and quantity of articles to be provided therein. The cavity 308 may be divided into one or more compartments (e.g., storage wells, etc.) for separating multiple articles and/or may include systems for holding or otherwise storing accessories, tools, and the like.

According to the illustrated embodiment, the cavity 308 is configured to receive an insert, shown as a pan well deck 310. The pan well deck 310 is shown as being divided into five storage wells 312 (e.g., two cavities provided in a front portion and three cavities provided in a rear portion). The pan well deck 310 is a separate component that is coupled within the cavity 308. The pan well deck 310 may be coupled within cavity 308 using any of a variety of suitable techniques (e.g., press-fit, snap-fit, adhesives, welding, etc.).

Similar to the cover portion 200, the base portion 300 further includes a portion or region (schematically shown as an extension 320) at a front portion of the base portion 300 for at least partially concealing and/or shielding a portion of the applicator 400. As shown, the extension 320 and the remaining portion of the base portion 300 are integrally formed as a single unitary body. Similar to the remaining portion of the base portion 300, the extension 320 includes a side wall 322 and an end surface 324. When the container 100 is in the closed position, the extension 320 cooperates with a the extension 210 of the cover portion 200 to define the cavity 216 configured to receive a portion of the applicator 400.

The base portion 300 further includes a structure for engaging the applicator 400. The base portion 300 includes a projection (e.g., rib, lip, etc.), shown as a flange 330 integrally formed with a front portion of side wall 204. The flange 330 includes a first portion 332 outwardly extending from the front portion of the side wall 304 and a second portion 334 upwardly extending from the first portion 332. When the container 100 is in the closed position, the flange 330 combines with the flange 220 of the cover portion 200 to provide a T-shaped flange configured to slidably engage a corresponding slot (e.g., channel, groove, key hole, etc.) on the applicator 400. The flange 330 has the same configuration as the flange 220 described above.

Figure 12:
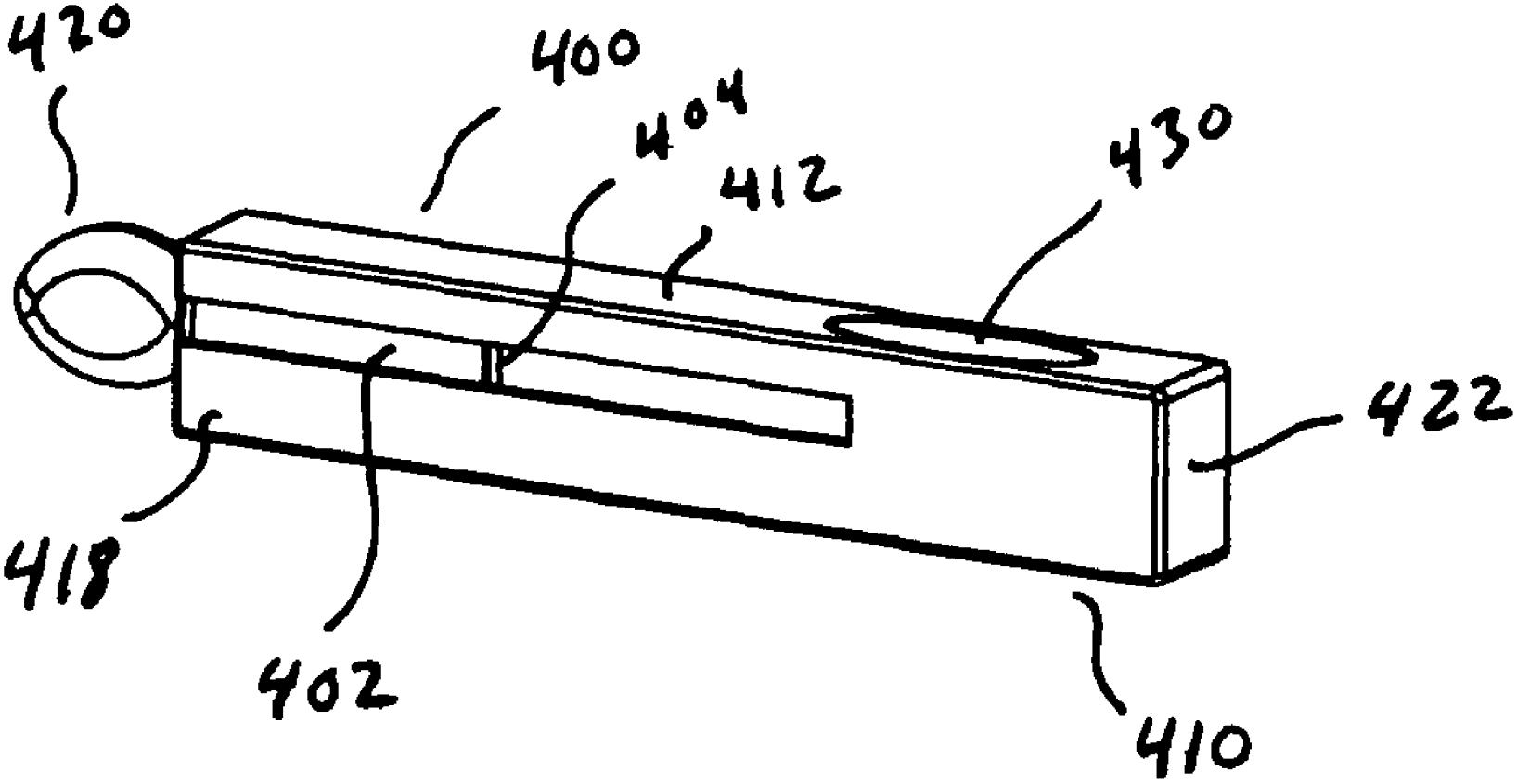
FIG. 12 is a schematic representation of a perspective view of a rear portion of an applicator according to an exemplary embodiment.

Referring to FIGS. 7, 8, and 12, an applicator 400 is shown according to an exemplary embodiment. The applicator 400 is configured to releasably engage the cover portion 200 and the base portion 300 to secure the container 100 in the storage position. According to the illustrated embodiment, the applicator 400 includes a slot (e.g., groove, key hole, etc.), shown as a channel 402, configured to slidably engage the cover portion 200 and the base portion 300. According to various alternative embodiments, the applicator may include any other suitable structure for engaging the cover portion and the base portion.

The applicator 400 has a body 410 and an operating portion 420. The body 410 includes a first surface (shown as a top surface 412), a second surface (shown as a front surface 414), a third surface (shown as a bottom surface 416), a fourth surface (shown as a rear surface 418), a fifth surface (shown as a first end surface 420), and a sixth surface (shown as a second end surface 422). The top surface 412, the front surface 414, the bottom surface 416, and the second end surface 422 cooperate with the cover portion 200 and the base portion 300 to define the outer surface of the container 100.

As mentioned, the applicator 400 includes a channel 402 configured to slidably engage the cover portion 200 and the base portion 300. FIG. 12 is a perspective view showing the rear surface 418 according to an exemplary embodiment. Channel 402 is shown as being disposed in the rear surface 418 and extending from the first end. Channel 402 extends a length sufficient to engage the corresponding structures on the cover portion 200 and the base portion 300. According to the embodiment illustrated, the channel 402 extends approximately three quarters of the length of the applicator body 410. The channel 402 has a cross section that corresponds to the combined cross section of the flange 220 and the flange 330. According to the embodiment illustrated, the channel 402 has a cross section that is substantially T-shaped (as shown in FIG. 11).

The applicator 400 also includes a structure for latching (e.g., locking, etc.) the applicator 400 in to the cover portion 200 and the base portion 300. Referring to FIG. 12, the applicator 400 is shown as including a projection or tab 404 provided within the channel 402. The tab 404 is configured to engage the projection 226 provided on the flange 220 and a similar structure provided on the flange 330. By providing the tab 404 and the projection 226, the applicators 400 frictionally engages (e.g., snap-fit, etc.) the cover portion 200 and the base portion 300 to retain the container 100 in a closed and latched position.

The applicator 400 may further include a structure for facilitating the moving of the applicator 400 from the latched position to the unlatched position. According to the embodiment illustrated, top surface 412 includes an indentation 430 to receive a thumb, finger, etc. of a user for facilitating the moving of the applicator 400 between the latched and unlatched positions. According to various alternative embodiments, the indentation 430 may be provided on another surface of the applicator 400 (e.g., front surface 414, bottom surface 416, etc.). According to a further alternative embodiment, the applicator 400 may be shaped in a manner (e.g., an ergonomic design, etc.) that facilitates in moving the applicator 400 between the latched and unlatched positions. For example, the applicator 400 may have one or more curved surface coinciding with the typical shape of the palm of a user.

With reference to FIGS. 1 and 5 through 7, the operation of the container 100 with be described. FIG. 1 shows the container 100 in the storage position (i.e., closed and latched) and the one or more articles supported therein are concealed by the cover portion 200. To reveal the one or more articles, a user must first actuate the applicator 400. Referring to FIG. 5, a user actuates the applicator 400 by sliding the applicator 400 in a direction substantially transverse to the movement of the cover portion 200 relative to the base portion 300 (e.g., from right to left) thereby disengaging the flange 220 and the flange 330 from the channel 402 of the applicator 400. Once the applicator 400 is disengaged, a user can open the cover portion 200 relative to the base portion 300. In the open position, a user make use the applicator to apply the article stored within the container 100. To return the container 100 to the storage position, a user must first close the cover portion 200 relative to the base portion 300. Once the cover portion 200 is closed, a user can slide the applicator 400 over the flanges 220 and 330 until the tab 404 on the applicator 400 engages the projection 226 on the flange 220.

As one of skill in the art will appreciate from the foregoing disclosure, the present application relates to a number of containers wherein a removable member is used secure a cover portion of the container to the base portion of the container. One nonexclusive exemplary embodiment of a container includes a base portion configured to support a cosmetic article and a cover portion pivotally coupled to a base portion and configured to move between a first position wherein the cosmetic article is concealed and a second position wherein the cosmetic article is revealed. The container further includes an applicator configured to slidably engage a projection formed by a portion of both the cover portion and the base portion for securing the container in a storage position.

As one skill in the art will further appreciate from the foregoing disclosure, the present application also relates to a number ways of securing a cover portion of a container to a base portion using a third member that is detachably coupled to the cover portion and the base portion. One nonexclusive exemplary embodiment relates closing a cover portion of a container relative to a base portion and using an applicator to latch the cover portion to the base portion by sliding the applicator about a portion of both the cover portion and the base portion of the container.

It is important to note that the construction and arrangement of the elements of the container as shown in the exemplary embodiment are illustrative only. Although only a few embodiments of the present invention have been described in detail in this disclosure, those skilled in the art who review this disclosure will readily appreciate that many modifications are possible (e.g., variations in sizes, dimensions, structures, shapes and proportions of the various elements, values of parameters, mounting arrangements, materials, colors, orientations, etc.) without materially departing from the novel teachings and advantages of the subject matter recited in the claims. For example, the member configured to latch the cover portion to the base portion may be configured to provide a function other than an applicator. Also, the position of the member configured to at least partially assist in the securement of the cover to the base may be anywhere about the container and is not limited to being disposed in a front portion of the container as illustrated in the drawings. Further, the member configured to at least partially assist in the securement of the cover to the base may engage the cover and/or the base in a manner other than slidably engage. Further, the container may be configured to hold articles, other than cosmetic substances. For example, the container may provide one or more cavities for supporting tissues (e.g., wet and/or dry, etc.). Further, the applicator may be configured as an additional cosmetic substance (e.g., lip stick, etc.).

Accordingly, all such modifications are intended to be included within the scope of the appended claims. The order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and/or omissions may be made in the design, operating conditions and arrangement of the preferred and other exemplary embodiments without departing from the spirit of the appended claims.

What is claimed is:

1. A case for storing a cosmetic, the case comprising:

a base having a first latch portion and configured to support the cosmetic, the first latch portion comprising a first projection;

a cover securable to the base and having a second latch portion, the second latch portion comprising a second projection; and an applicator for applying the cosmetic and having a third latch portion, the third latch portion comprising a slot, wherein the third latch portion engages the first latch portion and the second latch portion to secure the cover to the base when the case is in a closed position by having the slot receive both the first projection and the second projection, wherein the first projection and the second projection are flanges that each comprise a first portion and a second portion, the first portions outwardly extend from a front portion of the case, the second portion of the first projection downwardly extends from the first portion of the first projection, the second portion of the second projection upwardly extends from the first portion of the second projection.

2. The case of claim 1, wherein the first portions and the second portions cooperate to form a substantially T-shaped cross section when the case is in the closed position.

3. The case of claim 2, wherein the slot comprises an elongated channel having substantially T-shaped cross section configured to slidably engage the first latch portion and the second latch portion.

4. The case of claim 1, wherein the applicator has a substantially rectangular body and the slot extends partially along a side surface of the body.

5. The case of claim 1, further comprising:

a first locking tab provided on the second portion of the first latch portion;

a second locking tab provided on the second portion of the second latch portion; and a third locking tab provided within the slot, wherein the third locking tab directly engages both the first locking tab and the second locking tab to at least partially assist in securing the applicator to the base and the cover when the case in the closed position.

6. The case of claim 1, wherein the cover is pivotally coupled to the base about a hinge defining an axis of rotation.

7. The case of claim 6, wherein the third latch portion is configured to slidably engage the first latch portion and the second latch portion as the applicator moves in a direction that is substantially parallel with the axis of rotation defined by the hinge.

8. A compact case comprising:

a base;

a cover securable to the base about a hinge having an axis of rotation and moveable between a closed position and an open position relative to the base; and an applicator removably coupled to the base and the cover, the applicator being slidably engageable with both the base and cover in a direction substantially parallel to the axis of rotation to secure the case in the closed position, the applicator having an operating portion which substantially remains in a use position relative to a body portion when engaging the base and the cover, wherein the base and the cover cooperate to define an aperture configured to receive the operating portion of the applicator for shielding the operating portion, and wherein the applicator is configured to be selectively added to and removed from the base and the cover while the cover remains in the closed position relative to the base.

9. The compact case of claim 8, wherein the applicator is entirely detachable from the base and the cover.

10. The compact case of claim 8, wherein the operating portion of the applicator is one of a brush or a pad.

11. The compact case of claim 8, wherein the body portion of the applicator substantially defines an outer edge of the compact case when engaged with one of the base and the cover.

12. The compact case of claim 11, wherein the body portion of the applicator defines a front edge of the compact case.

13. The compact case of claim 8, wherein the compact case is substantially rectangular in shape and the body portion of the applicator at least partially defines a top surface, a bottom surface, a first sidewall and a second sidewall of the compact case.

* * * * *